US012788060B2

(12) United States Patent
Akiyama et al.

(10) Patent No.: US 12,788,060 B2
(45) Date of Patent: Nov. 10, 2026

(54) AEROSOL GENERATION DEVICE

(71) Applicant: JT International SA, Geneva (CH)

(72) Inventors: Takeshi Akiyama, Tokyo (JP); Karima Lakraa, Lausanne (CH); Ryo Hasegawa, Geneva (CH); Patrice Borne, Publier (FR)

(73) Assignee: JT International SA, Geneva (CH)

( * ) Notice: Subject to any disclaimer, the term of this patent is extended or adjusted under 35 U.S.C. 154(b) by 541 days.

(21) Appl. No.: 17/926,897

(22) PCT Filed: May 15, 2021

(86) PCT No.: PCT/EP2021/062902
§ 371 (c)(1),
(2) Date: Nov. 21, 2022

(87) PCT Pub. No.: WO2021/233792
PCT Pub. Date: Nov. 25, 2021

(65) Prior Publication Data

US 2023/0240362 A1 Aug. 3, 2023

(30) Foreign Application Priority Data

May 22, 2020 (EP) ..... 20176128

(51) Int. Cl.

| | |
|---|---|
| ***A24F 40/00*** | (2020.01) |
| ***A24F 7/00*** | (2006.01) |
| ***A24F 40/20*** | (2020.01) |
| ***A24F 40/40*** | (2020.01) |
| ***A24F 40/42*** | (2020.01) |
| ***A24F 40/46*** | (2020.01) |

(Continued)

(52) U.S. Cl.
CPC ..... *A24F 40/42* (2020.01); *A24F 7/00* (2013.01); *A24F 40/20* (2020.01); *A24F 40/46* (2020.01); *A24F 40/60* (2020.01)

(58) Field of Classification Search
None
See application file for complete search history.

(56) References Cited

U.S. PATENT DOCUMENTS

2010/0275937 A1 11/2010 Shakouri Moghadam et al.
2016/0235122 A1* 8/2016 Krietzman ..... A24B 15/16
(Continued)

FOREIGN PATENT DOCUMENTS

EP 2782463 A2 10/2014
EP 3167728 A1 5/2017
(Continued)

OTHER PUBLICATIONS

International Search Report for Application No. PCT/EP2021/062902 mailed Aug. 16, 2021, pp. 1-4.

*Primary Examiner* — Philip Y Louie
*Assistant Examiner* — Vu P Pham
(74) *Attorney, Agent, or Firm* — Lerner David LLP

(57) ABSTRACT

An aerosol generation device includes: a housing; a heating chamber arranged in the housing for generating an aerosol by heating a consumable; a cradle including a recess for holding the consumable; a slot extending through the housing and configured to receive the cradle and to position the cradle in a first position where the consumable is held in the heating chamber; and a compression element configured to compress the consumable in the recess of the cradle.

20 Claims, 8 Drawing Sheets

(51) Int. Cl.
*A24F 40/485* (2020.01)
*A24F 40/60* (2020.01)

(56) References Cited

U.S. PATENT DOCUMENTS

| | | | | |
|---|---|---|---|---|
| 2016/0367768 | A1* | 12/2016 | Pfrang | A61M 15/0035 |
| 2017/0095624 | A1* | 4/2017 | Davidson | A61M 15/0028 |
| 2018/0016040 | A1* | 1/2018 | Ewing | B65B 3/26 |
| 2019/0321570 | A1 | 10/2019 | Rubin | |
| 2021/0145050 | A1* | 5/2021 | Ricketts | A24F 40/40 |
| 2022/0273045 | A1* | 9/2022 | Poynton | A24F 40/20 |
| 2022/0322742 | A1* | 10/2022 | Batley | A24F 40/20 |

FOREIGN PATENT DOCUMENTS

| | | | |
|---|---|---|---|
| EP | 3456213 | A1 | 3/2019 |
| GB | 2527597 | A | 12/2015 |
| JP | 2014533513 | A | 12/2014 |
| JP | 2017526381 | A | 9/2017 |
| JP | 2019518423 | A | 7/2019 |
| WO | 2013076098 | A2 | 5/2013 |
| WO | 2015198015 | A1 | 12/2015 |
| WO | 2016023172 | A1 | 2/2016 |

* cited by examiner

AEROSOL GENERATION DEVICE

CROSS-REFERENCE TO RELATED APPLICATIONS

The present application is a national phase entry under 35 U.S.C. § 371 of International Application No. PCT/EP2021/062902, filed May 15, 2021, published in English, which claims priority to European Application No. 20176128.5 filed May 22, 2020, the disclosures of which are incorporated herein by reference.

TECHNICAL FIELD

The present disclosure relates to an aerosol generation device in which an aerosol generating substrate is heated to form an aerosol. The disclosure is particularly applicable to a portable aerosol generation device, which may be self-contained and low temperature. Such devices may heat, rather than burn, tobacco or other suitable aerosol substrate materials by conduction, convection, and/or radiation, to generate an aerosol for inhalation.

BACKGROUND

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat or warm aerosolisable substances as opposed to burning tobacco in conventional tobacco products.

A commonly available reduced-risk or modified-risk device is the heated substrate aerosol generation device or heat-not-burn device. Devices of this type generate an aerosol or vapour by heating an aerosol substrate that typically comprises moist leaf tobacco or other suitable aerosolisable material to a temperature typically in the range 150° C. to 350° C. Heating an aerosol substrate, but not combusting or burning it, releases an aerosol that comprises the components sought by the user but not the toxic and carcinogenic by-products of combustion and burning. Furthermore, the aerosol produced by heating the tobacco or other aerosolisable material does not typically comprise the burnt or bitter taste resulting from combustion and burning that can be unpleasant for the user and so the substrate does not therefore require the sugars and other additives that are typically added to such materials to make the smoke and/or vapour more palatable for the user.

In such devices, the aerosol substrate is heated by a heating element, for example in a heating chamber. The aerosol substrate is consumed through generation of the aerosol, and must be regularly replaced. It is therefore desirable to provide a convenient way of replacing the aerosol substrate in the heating chamber.

Additionally, it is desirable to generate more aerosol for a given quantity of aerosol substrate, and therefore it is desirable to provide a device that can heat the aerosol substrate to generate aerosol efficiently.

SUMMARY

According to a first aspect, the following disclosure provides an aerosol generation device comprising: a housing; a heating chamber arranged in the housing for generating an aerosol by heating a consumable; a cradle comprising a recess for holding the consumable; a slot extending through the housing and configured to receive the cradle and to position the cradle in a first position where the consumable is held in the heating chamber; and a compression element configured to compress the consumable in the recess of the cradle.

The cradle-and-slot configuration provides an intuitive and robust way to replace the aerosol substrate consumable. Additionally, by designing the cradle to receive the compression element, the consumable can be compressed during heating while remaining in the cradle. Compressing the consumable during heating has the effect of improving aerosol generation efficiency.

Optionally, the aerosol generation device further comprises an air flow channel for drawing the aerosol from the consumable, wherein a part of the air flow channel is formed within the housing.

Optionally, the compression element comprises a protrusion from a surface of the slot.

By providing the compression element as a feature of a surface of the slot, the device becomes simple to manufacture and robust in operation.

Optionally, the compression element comprises a moveable compression element.

A moveable compression element makes the device more adaptable. For example, the compression element may enable a user to adjust aerosol generation efficiency, or adjust a quality of the generated aerosol, according to their preference, or may be configured to provide different compression for different types of consumable.

Optionally, the moveable compression element is mechanically linked to an external push button.

Linking the compression element to an external button has the effect that the compression element can be moved without providing any energy storage (mechanical or electrical), and can be freely controlled by a user.

Optionally, the moveable compression element is configured to latch in a compression state and a release state, and is configured to alternate between the compression state and the release state upon successive uses of the external push button.

Providing a bistable latch having a compression state and a release state means that the button is more likely to be operated optimally even if a user has no understanding of the required compression for improving aerosol generation efficiency.

Optionally, the cradle comprises a cover arranged to at least partly cover the consumable in the recess, and the moveable compression element comprises the cover.

By providing a moveable cover, the consumable is inhibited from contacting an interior of the slot. Aerosol substrates often produce residues which may be sticky, requiring the device to be cleaned. By providing a cover, the required cleaning is more effectively confined to just the cradle.

Optionally, the cradle comprises a cradle heating element.

By providing a heating element that is part of the cradle, the heating element can be arranged optimally relative to the recess for holding the consumable, and any efficiency issues relating to alignment of the cradle with the heating chamber are reduced.

Optionally, the heating chamber comprises a chamber heating element, and the cradle comprises a thermally conductive element which, in the first position, is arranged between the chamber heating element and the recess.

By providing a heating element that is part of the heating chamber, there is no need to provide an energy supply to the cradle.

Optionally, the cradle is attached to the slot, and the cradle is configured to move between the first position and a second position at which the consumable can be received in or removed from the recess.

Optionally, the cradle is attached to the slot by a hinge.

By constraining the cradle so that it does not detach from the slot, but only moves within a defined range of motion, the device becomes easier to store and move without risk of losing the cradle.

Optionally, the aerosol generation device further comprises an air flow channel for drawing the aerosol from the consumable, wherein the housing or the cradle comprises an air flow inlet for taking air into the air flow channel.

By allowing air flow through an inlet of the cradle, the air flow channel is less affected by any air flow leaking through the slot when the cradle is inserted.

Optionally, the cradle comprises the air flow inlet, the device is elongate along a first axis, a mouthpiece is located at a first end of the device along the first axis and, when the cradle is in the first position, the air flow inlet is arranged on a side between the ends of the device along the first axis.

Optionally, the slot extends obliquely relative to the first axis.

Optionally, the aerosol generation device comprises an air flow channel for drawing the aerosol from the consumable, wherein the housing or the cradle comprises a mouthpiece for drawing aerosol out of the device.

DETAILED DESCRIPTION

Figure 1:
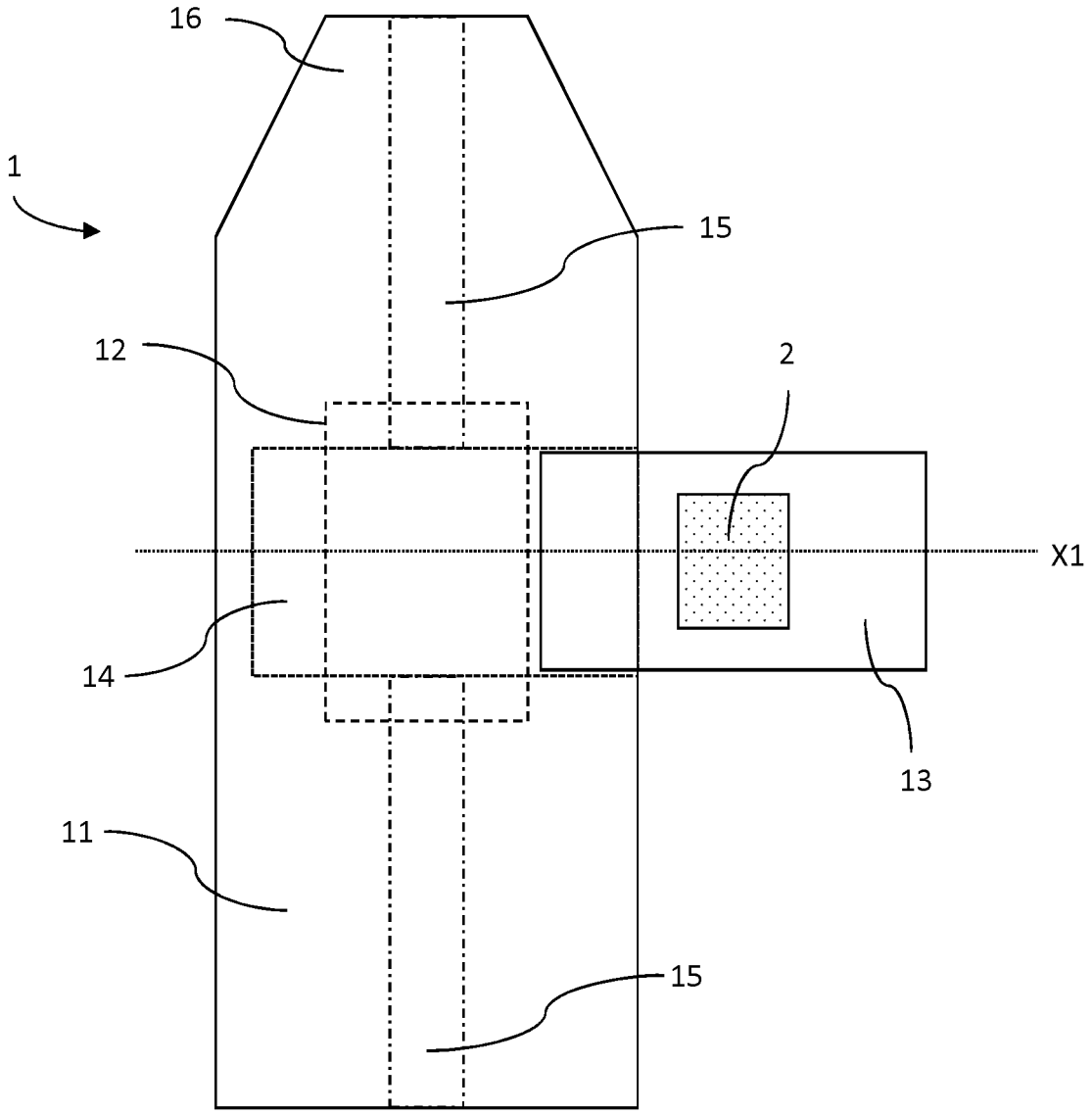
FIG. 1 schematically illustrates an aerosol generation device according to a first example.

FIG. 1 schematically illustrates an aerosol generation device 1 according to a first example.

The aerosol generation device 1 comprises a housing 11 enclosing a heating chamber 12 for heating a consumable 2 to generate an aerosol.

The aerosol generation device 1 is configured to work with a substantially cuboid consumable 2. In a typical example, the consumable 2 is typically 18×12×1.2 mm. The aerosol substrate may for example comprise nicotine or tobacco and an aerosol former. Tobacco may take the form of various materials such as shredded tobacco, granulated tobacco, tobacco leaf and/or reconstituted tobacco. Suitable aerosol formers include: a polyol such as sorbitol, glycerol, and glycols like propylene glycol or triethylene glycol; a non-polyol such as monohydric alcohols, acids such as lactic acid, glycerol derivatives, esters such as triacetin, triethylene glycol diacetate, triethyl citrate, glycerin or vegetable glycerin. In some embodiments, the aerosol generating agent may be glycerol, propylene glycol, or a mixture of glycerol and propylene glycol. The substrate may also comprise at least one of a gelling agent, a binding agent, a stabilizing agent, and a humectant. The aerosol substrate may be porous such that air can flow through the substrate and collect aerosol as it does so. The substrate may for example be a foam, or packed strands or fibres. The substrate may be formed through an extrusion and/or rolling process into a stable shape. The consumable may also comprise an air permeable wrapper covering at least part of a surface of the aerosol generating substrate. The wrapper may, for example, comprise paper and/or non-woven fabric.

The heating chamber 12 may simply be an interior volume of the housing 11, but the heating chamber 12 is preferably enclosed by an insulating enclosure within the housing 11, so that additional components such as control circuitry and an electrical power source (not shown) insulated from heat provided within the heating chamber 12. The housing may generally be made from any rigid material such as a thermoplastic or a metal (e.g. aluminium). The insulating enclosure may, for example, be made from a heat-resistant material such as polyethylene terephthalate (PET), polybutylene terephthalate (PBT), or polyamide (PA) in order to prevent thermal deformation or melting. The heat-resistant material may be a super engineering plastic such as polyimide (PI), polyphenylenesulfide (PPS) or polyether ether ketone (PEEK).

The consumable 2 is positioned in the heating chamber 12 by inserting a cradle 13 carrying the consumable 2 into a slot 14. The slot 14 extends through an opening in an exterior surface of the housing 11 and extends up to or through the heating chamber 12. When the cradle 13 is inserted, the slot 14 guides the cradle 13 into a first position where the consumable 2 is held in the heating chamber 12. However, as shown in FIG. 1, the cradle 13 is in a second position partly extracted from the slot 14, where the consumable 2 can be added to or removed from the cradle 13.

During or after a time at which the consumable 2 is heated to generate the aerosol, air is driven along an air flow channel 15 to provide the aerosol at an air flow outlet. The air flow channel 15 may, for example, comprise an air flow inlet at one location on an exterior of the housing 11, a tube connecting the air flow inlet to the heating chamber 12 and a tube connecting the heating chamber 12 to an air flow outlet, as shown in FIG. 1. In this embodiment, the air flow outlet is part of the mouthpiece 16, and the air is driven by a user inhaling. In other embodiments, the aerosol generation device 1 may comprise a pump for pumping air along the air flow channel 15, to provide the aerosol at the air flow outlet.

Figure 2A:
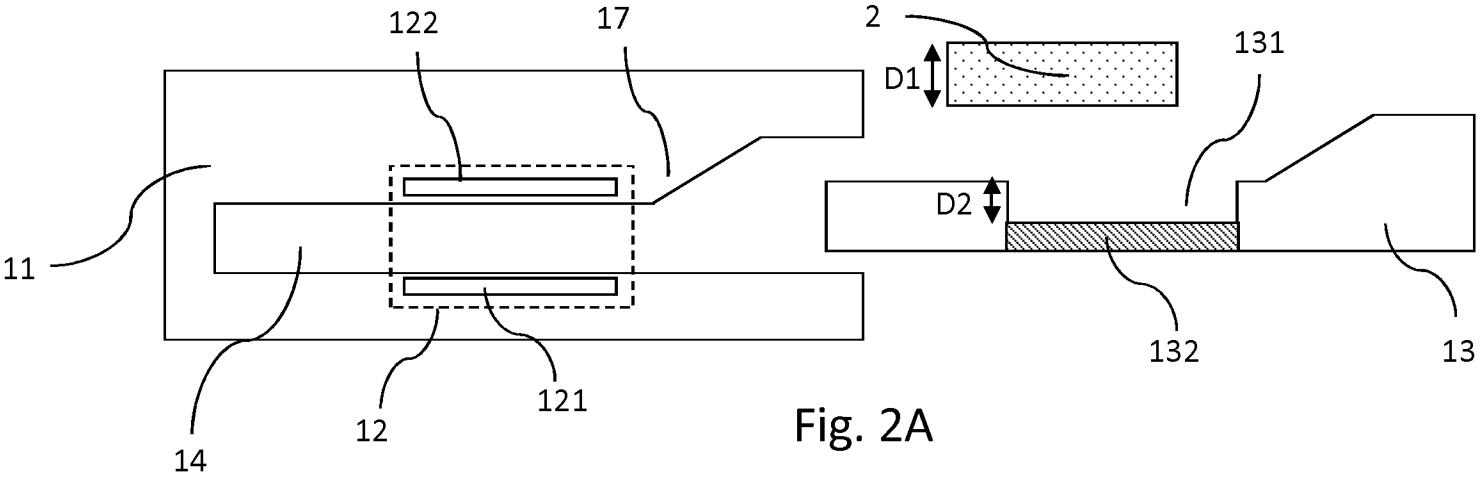
FIGS. 2A and 2B schematically illustrate a cross-section of the aerosol generation device according to the first example.
Figure 2B:
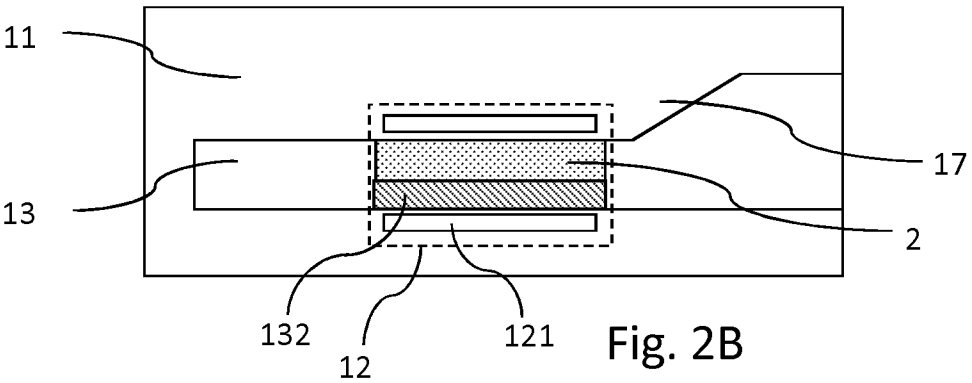

FIG. 1 also illustrates a line X1 used for reference in FIGS. 2A and 2B. More specifically, FIGS. 2A and 2B schematically show a cross-section through the aerosol generation device 1 along the line X1.

FIG. 2A illustrates the aerosol generation device 1 in an open state where the cradle 13 is separated from the housing 11.

As shown in FIG. 2A, within the housing 11, the slot 14 extends through the heating chamber 12, and is adapted to receive the cradle 13 which has dimensions corresponding to the slot.

Beside the slot, the heating chamber 12 comprises one or more chamber heating elements 121, 122 arranged to supply heat for heating the consumable 2. The heating elements are preferably electric heating elements, such as resistive heating elements, but any type of heating element suitable for supplying heat to the heating chamber 12 may be used.

The cradle 13 has a recess 131 for receiving and holding the consumable 2. A depth D2 of the recess 131 is smaller than a depth D1 of the consumable 2 such that, when the consumable 2 is arranged in the recess 131, the consumable 2 partly protrudes out of the recess 131.

FIG. 2B illustrates the aerosol generation device 1 in a state ready to generate aerosol, where the cradle 13 is in the first position in the slot 14, and the consumable 2 is in the heating chamber 12.

The slot 14 has a varying cross-section, providing compression element 17 in the form of a protrusion from a surface of the slot 14, such that the cross-section of the slot 14 is reduced. As shown in FIG. 2B, when the cradle 13 is in the first position, the compression element 17 reduces the space available for the consumable 2 to protrude out of the recess 131, and the consumable 2 is compressed in the recess 131 when the cradle 13 is in the first position. Specifically, in this example, the cradle 13 is adapted to be flush against a wall of the slot 14 when in the first position, so that the depth D1 of the consumable becomes equal to the depth D2 of the recess 131. The cross-section of the slot 14 preferably varies continuously, so that the consumable 2 is compressed and does not become stuck.

In this example, the cradle 13 has a thermally conductive element 132 which, in the first position, is arranged between the chamber heating element 121 and the recess 131 holding the consumable 2. The thermally conductive element 132 may, for example, be configured as a bottom surface of recess 131. The thermally conductive element 132 has the effect of improving heat conduction through the cradle 13 to the consumable 2. For example, a main body of the consumable may be made of a thermally insulating material or heat resistant material such as PEEK, while the thermally conductive element 132 is made of a heat conductor such as a metal plate. The cradle 13 could instead be made mostly of a thermally conductive material, but this would spread heat away from the consumable 2 as well as increasing heat conduction to the consumable 2.

Figure 3A:
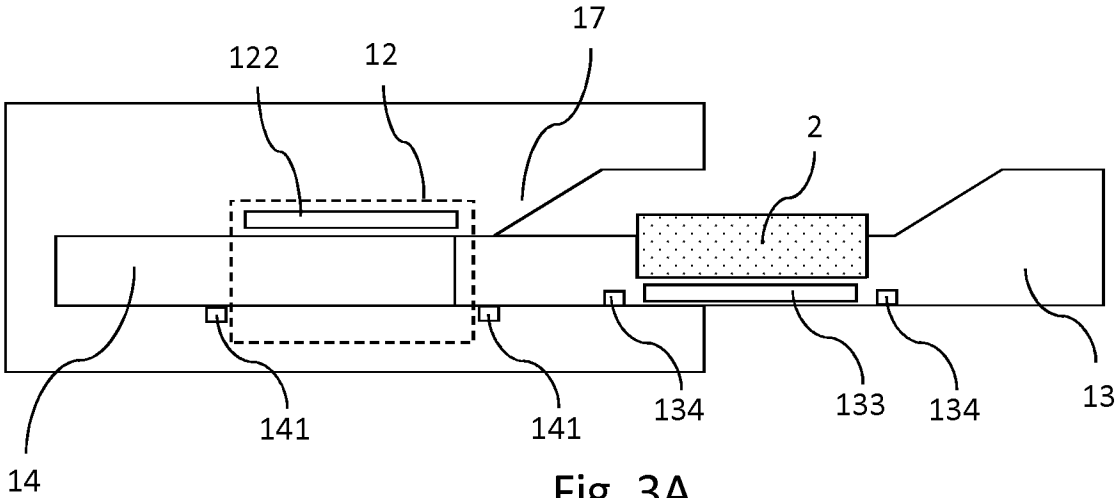
FIGS. 3A and 3B schematically illustrate a cross-section of an aerosol generation device according to a second example.
Figure 3B:
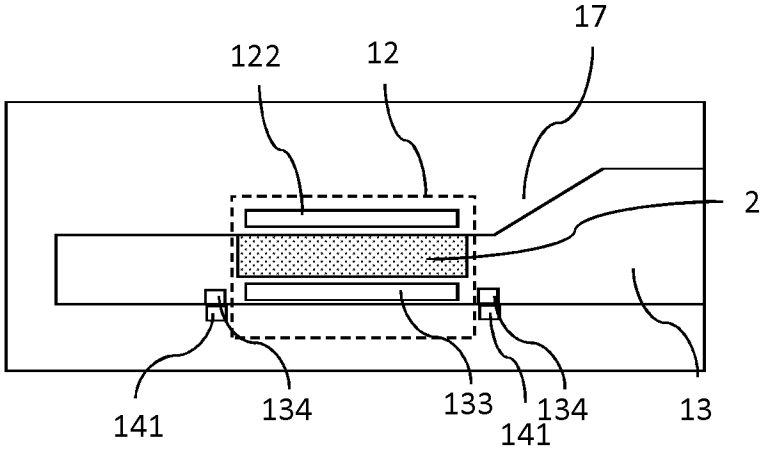

FIGS. 3A and 3B illustrate a second example of the aerosol generation device 1. The second example may have corresponding features to FIG. 1 of the first example, and is largely similar to FIGS. 2A and 2B of the first example, with like references indicating like features, and the differences being described below.

Specifically, in the second example, the cradle 13 has a cradle heating element 133 arranged to supply heat to the recess 131 of the cradle 13. The cradle heating element 133 may replace one or more chamber heating elements 121, 122 and may also replace the thermally conductive element 132 of the cradle 13. The cradle heating element 133 has the advantage of supplying heat from a fixed position in the cradle 13, so that supply of heat to the consumable 2 can be more precisely controlled.

However, using a cradle heating element 133 means that a supply of energy is required in the cradle 13. The cradle 13 may in some embodiments comprise its own power source. However, in the example illustrated in FIGS. 3A and 3B, the cradle 13 and the slot 14 each comprise electrical contacts 134 and 141. When the cradle 13 is in the first position, the electrical contacts 134 of the cradle 13 connect electrically with the electrical contacts 141 of the slot 14, so that the cradle 13 (and the cradle heating element 133) can receive power from a power source (not shown) held in the housing 11, or connect to an external power source through the housing 11. Even in cases where the cradle 13 comprises its own power source, the electrical contacts 134 and 141 may be used, for example, to enable detection that the cradle 13 is in the first position, to control activation of the cradle heating element 133.

In general, embodiments of the invention may have any combination of heating elements fixed in the heating chamber or fixed in the cradle.

Figure 4A:
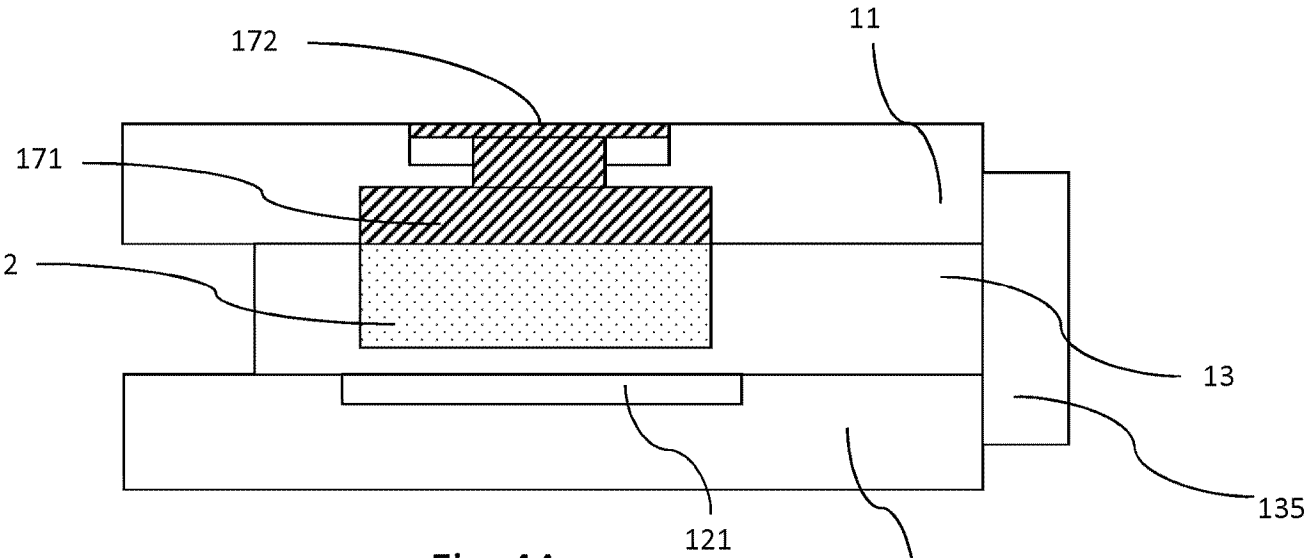
FIGS. 4A and 4B schematically illustrate a cross-section of an aerosol generation device according to a third example.
Figure 4B:
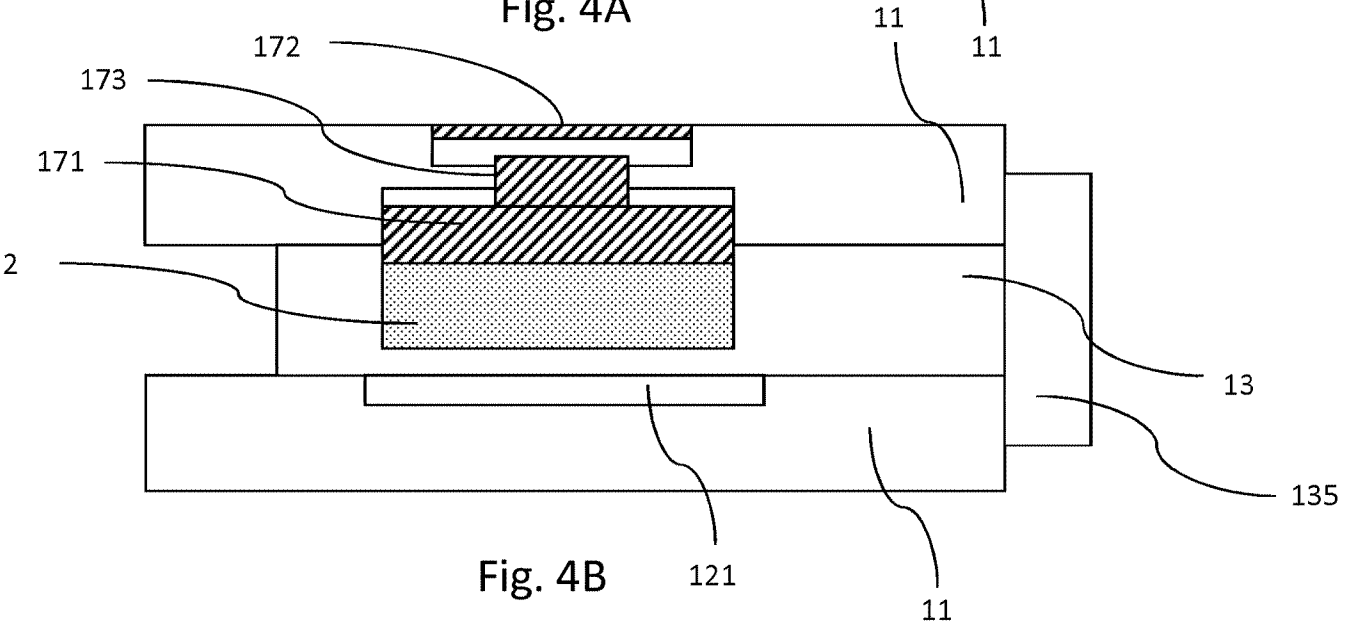

FIGS. 4A and 4B illustrate a cross-section of a third example of the aerosol generation device 1 having a different compression element 17 from the previous examples. The general configuration shown in FIG. 1 is again applicable to this example, and like figure references indicate like features.

In the third example, the compression element 17 comprises a moveable element 171. When the cradle 13 is in the first position, the moveable element 171 is aligned with the recess 131, and is operable to move to compress the consumable 2 in the recess 131.

The moveable element 171 may, in some embodiments, be operated by an electrical actuator. However, in the third example, the moveable compression element 171 is mechanically linked to an external manual control 172, in this case a button, accessible on the exterior of the housing 11 and configured to be operated by a user of the device 1.

Compression by the moveable element 171 may be provided entirely manually, the by user holding the manual control 172 in a compression state. However, as shown in FIG. 4B, the moveable element 171 is preferably configured to remain in the compression state even when the manual control 172 is released. This may be achieved by providing a bistable switch element 173 configured to latch in the compression state where the consumable 2 is compressed and (optionally) the cradle 13 is locked in the first position (as in FIG. 4B) after a first use of the manual control 172. Upon a second use of the manual control 172, the bistable switch element 173 may latch in a release state where the consumable 2 is not compressed and the cradle 13 can be moved (as in FIG. 4A) after a second use of the manual control 172. The moveable element 171 may thus be configured to alternate between the compression state and the release state upon successive uses of the manual control 172.

As shown in FIGS. 4A and 4B, the third example has a further optional feature of providing a handle 135 for the cradle 13. The handle 135 is configured such that it cannot pass into the slot 14, and can be held to remove the cradle 13 from the slot 14.

In FIGS. 4A and 4B, the chamber heating element 122 is omitted. However, the moveable compression element 171 may comprise a heating element configured to supply heat to the heating chamber.

Figure 5A:
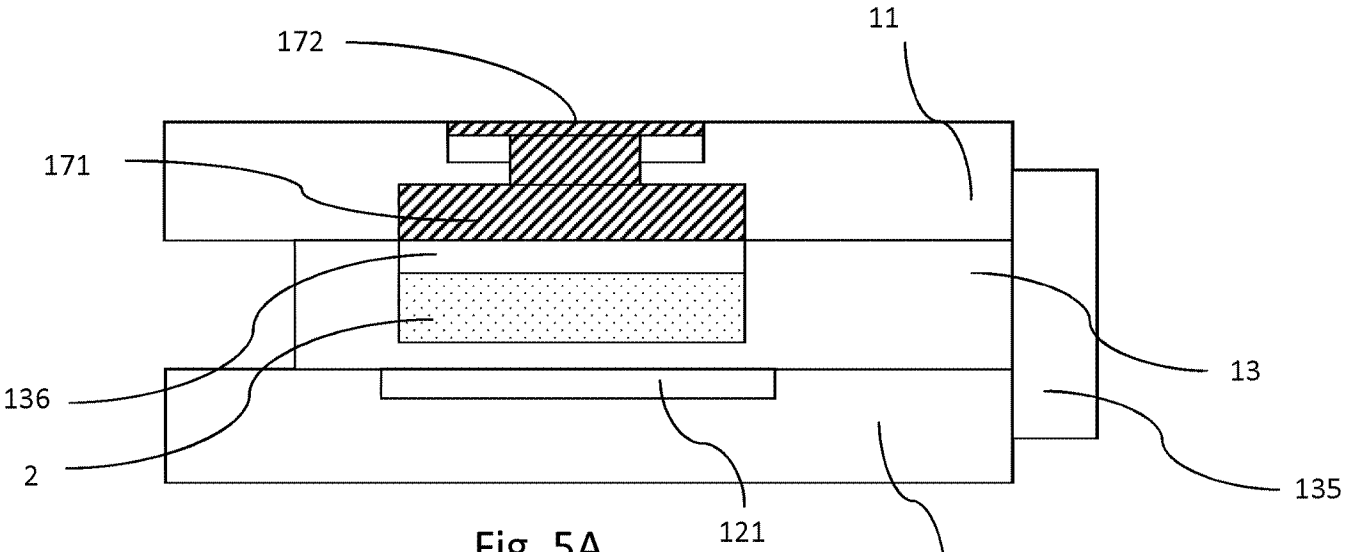
FIGS. 5A and 5B schematically illustrate a cross-section of an aerosol generation device according to a fourth example.
Figure 5B:
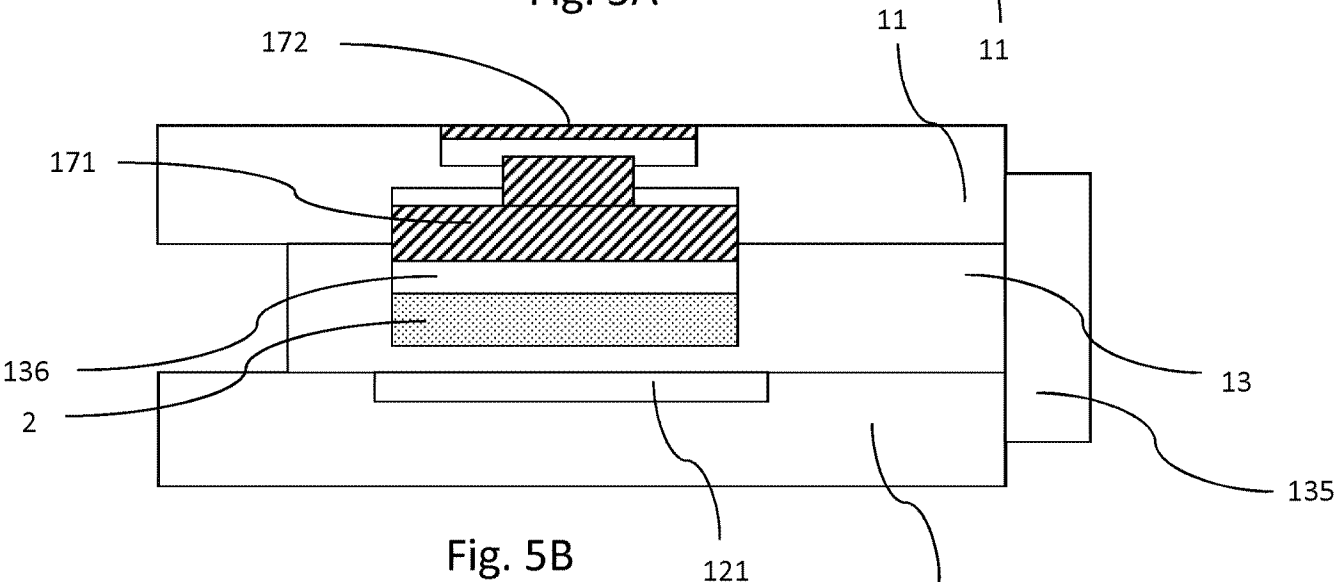

FIGS. 5A and 5B illustrate a cross-section of a fourth example of the aerosol generation device 1, which is a modified version of the third example. Specifically, the fourth example differs from the third example by the use of a cover 136 arranged to cover the consumable 2 in the recess 131.

The cover 136 is arranged to prevent the consumable 2 from contacting the compression element 17 or 171. Specifically, the cover 136 is configured as a further moveable compression element that compresses the consumable 2 and is itself moved either by a protruding surface 17 as in the first or second example, or by a moveable compression element 171 as in the third example.

The cover 136 may, for example, take the form of a hinged door which, when the cradle 13 is moved to the second position at which the consumable can be received in or removed from the recess, can be opened. When the cradle 13 is moved to the first position where the consumable 2 is in the heating chamber 12, the hinge of the cover 136 may be configured to move within a body of the cradle 13, for example along a rail, so that the cover 136 moves from the release position shown in FIG. 5A to the compression position shown in FIG. 5B, to compress the consumable 2.

The advantage of such a cover 136 is that the consumable 2 does not touch the interior of the slot 14 or the compression element 17, 171 that are inside the housing 11. This means that the device is easier to clean, because residue from the consumable 2 is less likely to be deposited outside of the cradle 13.

In FIGS. 5A and 5B, the chamber heating element 122 is omitted. However, the moveable compression element 171 may comprise a heating element configured to supply heat to the heating chamber. In this case, the cover 136 may be configured as a thermally conductive element 132 as described above with reference to the first example (FIGS. 2A and 2B). As a further alternative, the cover 136 may comprise a cradle heating element 133 as described above with reference to the second example (FIGS. 3A and 3B).

In embodiments where the manual control 172 is omitted, the moveable compression element 171 could also be omitted, and the cover 136 may be directly connected to an electronic actuator configured to provide a compression force.

Figure 6A:
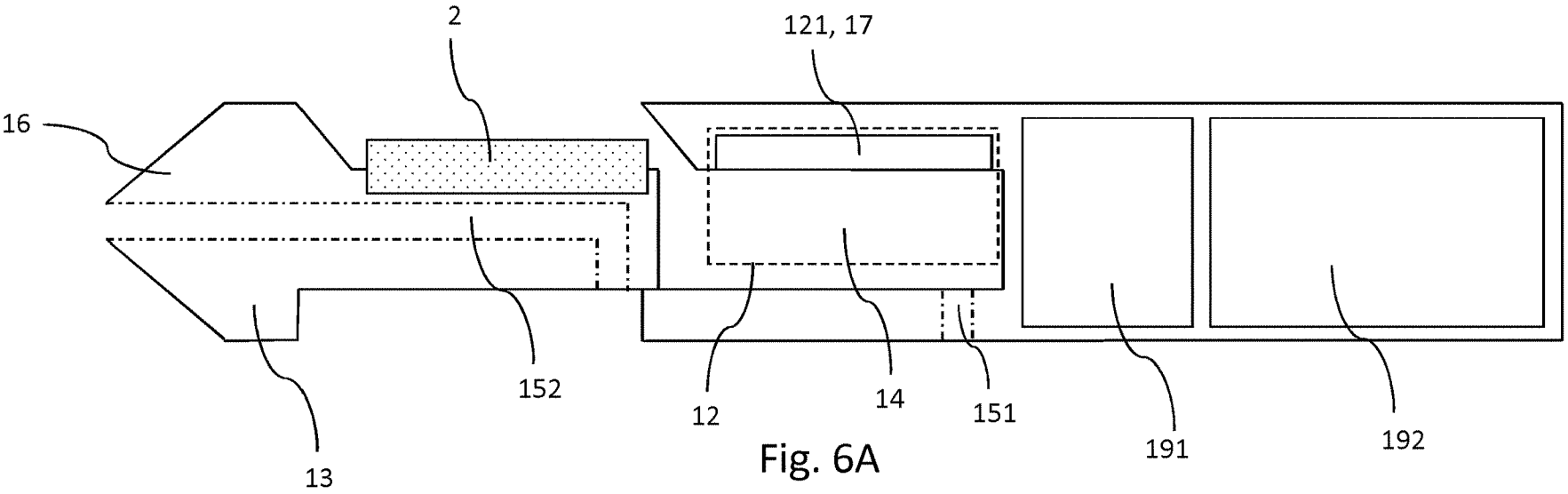
FIGS. 6A and 6B schematically illustrate a cross-section of an aerosol generation device according to a fifth example.
Figure 6B:
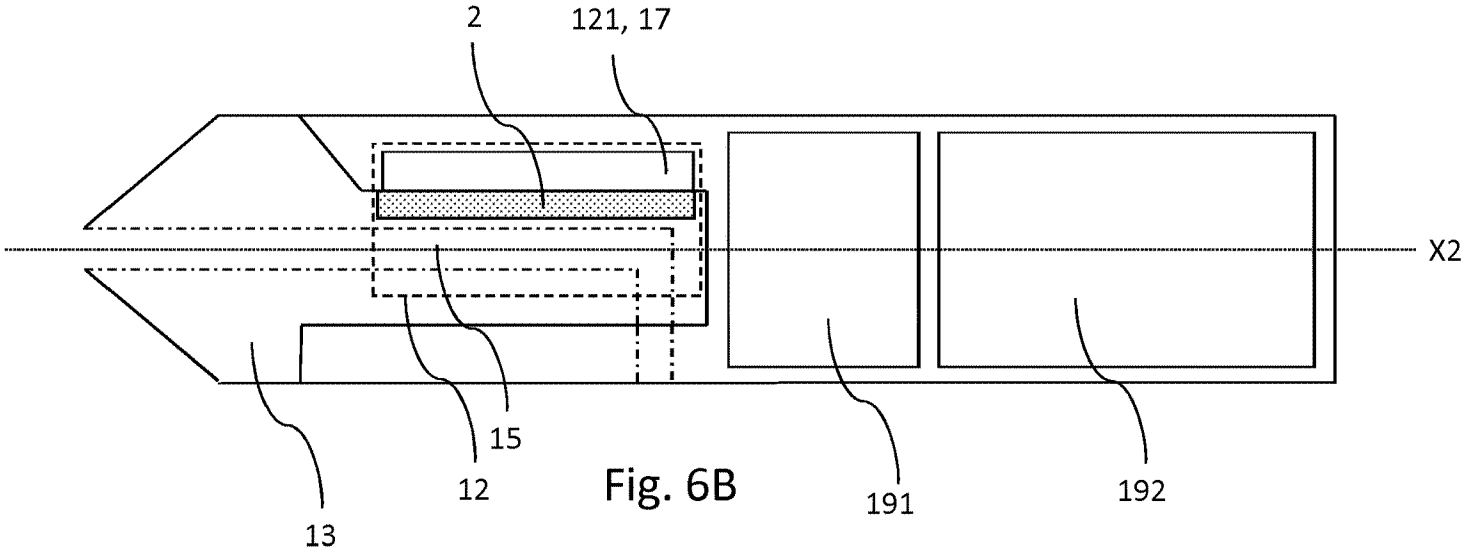

FIGS. 6A and 6B schematically illustrate a cross-section of a fifth example of the aerosol generation device 1, with the cradle 13 in an open position outside the housing 11, and the first position with the consumable 2 adjacent to the heating element 121, respectively. The fifth example differs from FIG. 1 in that the mouthpiece 16 forms part of the cradle 13, and a part 152 of the air flow channel is formed within the cradle 13 while another part 151 of the air flow channel 15 is formed within the housing 11.

Additionally, FIGS. 6A and 6B illustrate a possible arrangement for control circuitry 191 and a power source 192 which may be used to control and drive the heating element 121 (and optionally drive an actuator for a moveable compression element 171, 136).

The compression element 17 in the fifth example is similar to that of the first and second examples (FIGS. 2A to 3B). However, the features of the fifth example may be combined with a moveable compression element 171 and/or 136 as described for the third and fourth examples (FIGS. 4A to 5B).

As shown in FIGS. 6A and 6B, the inlet 151 of the air flow channel 15 is connected to a side of the device 1 relative to a "long" axis between the mouthpiece 16 and an opposing end of the device. Such a "long" configuration is convenient for the device 1 to be handheld while a user inhales from the mouthpiece 16, and arranging an air flow inlet 151 on a side relative to the long axis means that space can be reserved for the control circuitry 191 and the power source 192 without needing to fit these around the air flow channel 15 (as would be the case in the configuration of FIG. 1).

As the cradle 13 moves between the states shown in FIGS. 6A and 6B, the cradle 13 moves parallel to the slot 14 between a second position (FIG. 6A) at which the consumable 2 can be received in or removed from the recess 131, and the first position (FIG. 6B) where the consumable 2 is held in the heating chamber 12. However, the motion of the cradle 13 need not be directly in and out of the slot, as illustrated in FIGS. 7A and 7B.

Figure 7A:
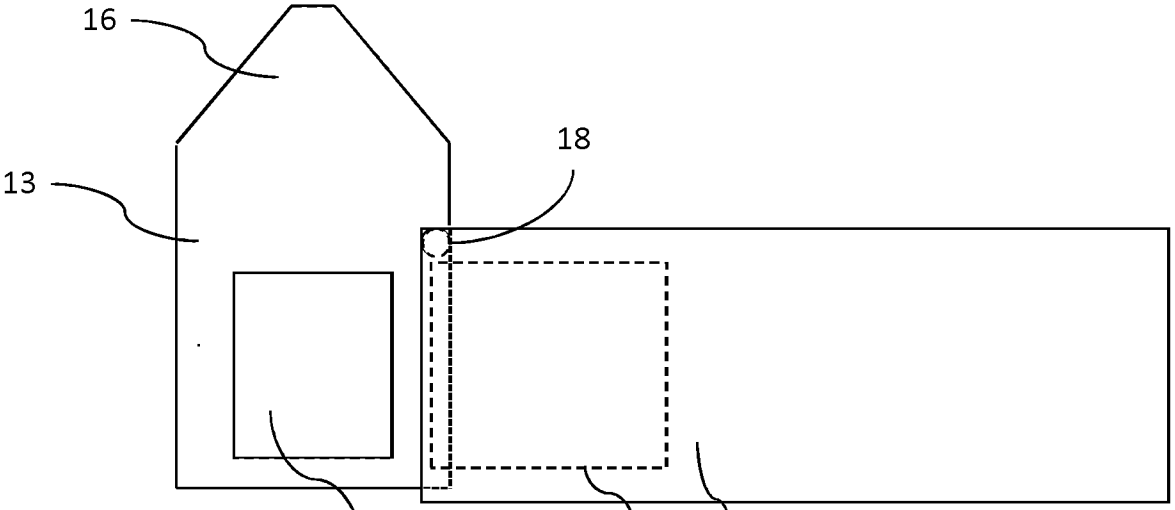
FIGS. 7A and 7B schematically illustrate an aerosol generation device according to a sixth example.
Figure 7B:
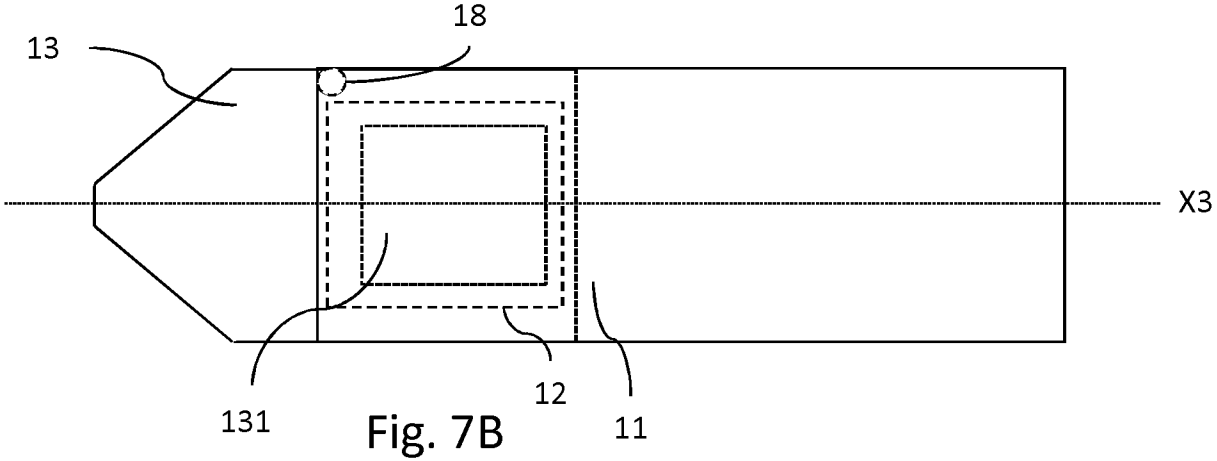

FIGS. 7A and 7B schematically illustrate a sixth example of an aerosol generation device 1 which differs from the fifth example in that the cradle 13 is attached to the slot 14 by a hinge 18.

Relative positioning of the planes of FIGS. 7A and 7B compared to FIGS. 6A and 6B are illustrated using lines X2 and X3. FIGS. 7A and 7B provide views from "above" the recess 131, whereas FIGS. 6A and 6B provide views from the "side" of the recess 131 and showing a depth of the recess 131.

FIG. 7A illustrates the cradle 13 at a second position of the range of motion available by pivoting the cradle 13 relative to the housing 11 around the hinge 18. In this position, the recess 131 is outside the housing 11, and a consumable 2 can be received in or removed from the recess 13.

FIG. 7B illustrates the cradle 13 at a first position of the range of motion available by pivoting the cradle 13 relative to the housing 11 around the hinge 11. In the first position, the recess 131 (and the consumable 2 it is expected to carry) is arranged inside the housing 11 and in the heating chamber 12.

The cradle 13 can be attached to the slot 14 in other ways. For example, the cradle 13 may be constrained to move parallel to the slot 14, within a predetermined ranged of relative linear motion. For example, the slot 14 and/or cradle 13 may comprise a protrusion arranged to prevent the cradle 13 from completely leaving the slot 14. A furthest position of the cradle 13 out of the slot 14 can be regarded as the second position where the consumable can be received in or removed from the recess, while the first position can be defined as the furthest position inside the slot 14 which can be reached by the cradle 13.

Figure 8:
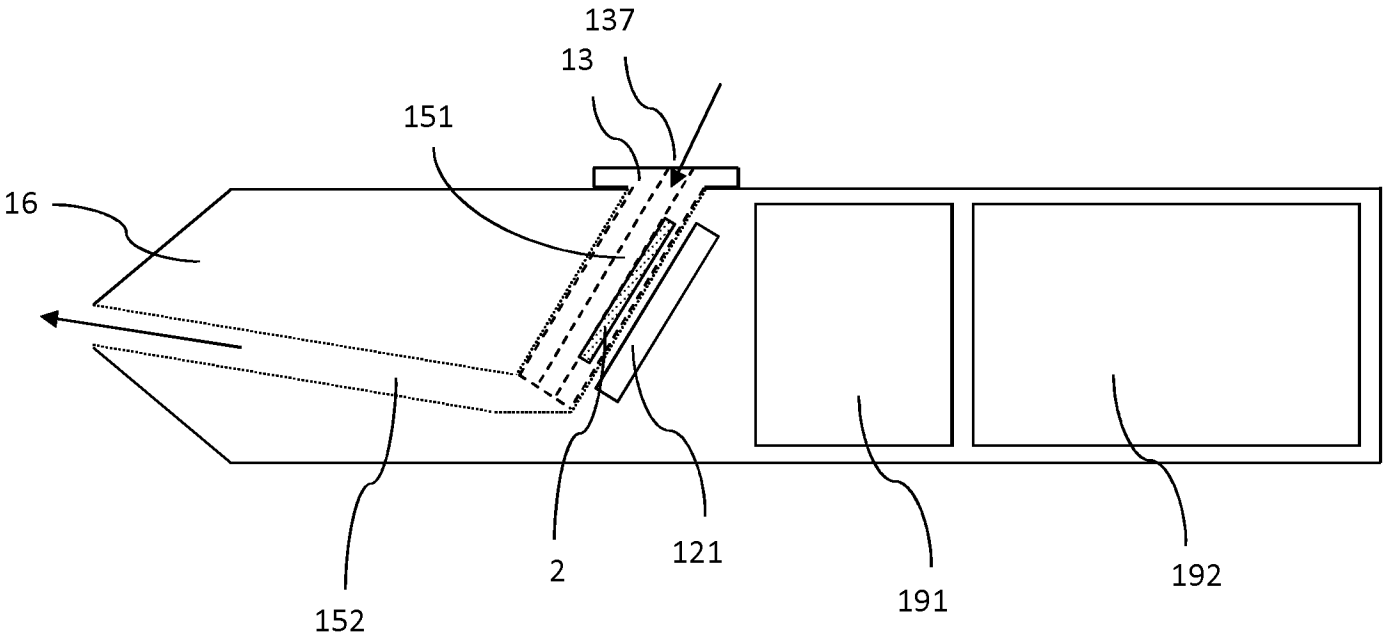
FIG. 8 schematically illustrates an aerosol generation device according to a seventh example.

FIG. 8 illustrates a seventh example of the aerosol generation device 1. The seventh example differs from the above described examples in that the cradle 13 comprises an air flow inlet 137 for taking air into the air flow channel 151. Air flows along a part 151 of the air flow channel comprised in the cradle 13, past the consumable 2, and to a part 152 of the air flow channel comprised in the housing 11, connecting to the mouthpiece 16.

A cradle 13 having an air flow inlet 137 may be arranged as in FIG. 1. However, the slot 14 and cradle 13 are preferably configured such that, when the cradle 13 is in the first position with the consumable 2 arranged for aerosol generation, the air flow inlet 137 is on a side of the device 1. More specifically, the device 1 may be an elongate device with a mouthpiece 16 at one end along the "long" axis. This type of shape is convenient for a user to hold the device 1 while inhaling from the mouthpiece 16. The air flow inlet 137 may be located on a side of the device relative to the long axis of the device 1. This configuration means that air does not flow along the whole length of the device 1 (as it does in the example of FIG. 1), and space at one end of the device can be reserved for other elements of the device 1 such as control circuitry 191 or a power source 192.

More specifically, the slot 14 may be configured such that, when the cradle 13 is in the first position, the slot 14 extends obliquely relative to the "long" axis. This configuration means that a longer cradle 13 can be employed with an air flow inlet 137 on the side, without making the overall housing 11 wider.

The aerosol generation device 1 of the seventh example may have any of the above described compression elements 17, 171, 136, and any of the above-described heating element configurations.

The invention claimed is:

1. An aerosol generation device comprising:

a housing;

a heating chamber arranged in the housing for generating an aerosol by heating a consumable;

a cradle comprising a recess, the recess having a fixed shape and configured for insertion of the consumable therein by a user;

a slot extending through the housing and configured to receive the cradle and to position the cradle in a first position where the consumable is held in the heating chamber;

a compression element configured to compress the consumable in the recess of the cradle; and an air flow channel for drawing the aerosol from the consumable, wherein a part of the air flow channel is formed within the housing;

wherein the cradle is configured to be flush with an outer wall of the housing.

2. The aerosol generation device according to claim 1, wherein the compression element comprises a protrusion from a surface of the slot.

3. The aerosol generation device according to claim 1, wherein the compression element comprises a moveable compression element.

4. The aerosol generation device according to claim 3, wherein the moveable compression element is mechanically linked to an external manual control.

5. The aerosol generation device according to claim 4, wherein the moveable compression element is configured to latch in a compression state and a release state, and is configured to alternate between the compression state and the release state upon successive uses of the external manual control.

6. The aerosol generation device according to claim 3, wherein the cradle comprises a cover arranged to at least partly cover the consumable in the recess, and the moveable compression element comprises the cover.

7. The aerosol generation device according to claim 1, wherein the cradle comprises a cradle heating element.

8. The aerosol generation device according to claim 1, wherein the heating chamber comprises a chamber heating element, and the cradle comprises a thermally conductive element which, in the first position, is arranged between the chamber heating element and the recess.

9. The aerosol generation device according to claim 1, wherein the cradle is attached to the slot, and the cradle is configured to move between the first position and a second position at which the consumable is configured to be received in or removed from the recess.

10. The aerosol generation device according to claim 9, wherein the cradle is attached to the slot by a hinge.

11. The aerosol generation device according to claim 1, wherein the housing or the cradle comprises an air flow inlet for taking air into the air flow channel.

12. The aerosol generation device according to claim 11, wherein the cradle comprises the air flow inlet, the device is elongate along a first axis, a mouthpiece is located at a first end of the device along the first axis and, when the cradle is in the first position, the air flow inlet is arranged on a side between ends of the device along the first axis.

13. The aerosol generation device according to claim 12, wherein the slot extends obliquely relative to the first axis.

14. The aerosol generation device according to claim 1, wherein the housing or the cradle comprises a mouthpiece for drawing aerosol out of the device.

15. The aerosol generation device of claim 1, wherein the housing extends along a longitudinal axis and the compression element includes a surface extending obliquely relative to the longitudinal axis.

16. The aerosol generation device of claim 1, wherein the compression element is configured such that compression of the consumable progresses from a leading end of the cradle to a trailing end of the cradle during insertion of the cradle toward the first position in the slot.

17. The aerosol generation device of claim 1, wherein the recess of the cradle defines an opening configured for removal of the consumable therefrom by the user after use of the device.

18. The aerosol generation device of claim 1, wherein the recess is bound by a plate and includes an opening opposite the plate.

19. The aerosol generation device of claim 1, wherein the compression element configured to compress the consumable relative to the recess of the cradle.

20. The aerosol generation device of claim 1, wherein the cradle is configured to define an outer portion of the device.

* * * * *